US006257709B1

(12) United States Patent
Ueda

(10) Patent No.: US 6,257,709 B1
(45) **Date of Patent: *Jul. 10, 2001**

(54) IMAGE FORMING APPARATUS

(75) Inventor: Atsushi Ueda, Yamatokoriyama (JP)

(73) Assignee: Sharp Kabushiki Kaisha, Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/093,798

(22) Filed: Jun. 9, 1998

(30) Foreign Application Priority Data

Jun. 10, 1997 (JP) ..... 9-151937

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/55, 292, 293, 294, 295

(56) References Cited

U.S. PATENT DOCUMENTS

| | | | | |
|---|---|---|---|---|
| 5,036,341 | | 7/1991 | Larsson . | |
| 5,559,586 | * | 9/1996 | Wada | 347/55 |
| 5,825,384 | * | 10/1998 | Fujita | 347/55 |

OTHER PUBLICATIONS

Note—On Page 1, Line 15, this patent is referenced in the specification as JP–A 6–30901. This if an error and should be JP–B2 6–30901. This will be corrected at a later date. JP–A 4–189555 is also described in the specification.

* cited by examiner

*Primary Examiner*—John Barlow
*Assistant Examiner*—Raquel Yvette Gordon
(74) *Attorney, Agent, or Firm*—David G. Conlin; Peter F. Corless; Dike, Bronstein, Roberts & Cushman, IP Group

(57) ABSTRACT

An object of the invention is to provide an image forming apparatus which can form an image having high quality. The image forming apparatus of the invention at least comprises: a supply section having a toner carrier; a counter electrode disposed facing the toner carrier; a control electrode which is interposed between these toner carrier and counter electrode and which comprises an insulating substrate, a plurality of gates which are formed on the insulating substrate, and two-layer electrode groups composed of a plurality of electrodes individually provided on the peripheries of the plurality of gates; and a control mechanism which can apply a predetermined potential to individual electrodes, the image forming apparatus being constructed in a manner that the predetermined potential is applied to the electrode in a controlled fashion so that the passage of toner through the gate is controlled, and thus an image is formed on a surface of a recording medium fed between the control electrode and counter electrode. Further, the image forming apparatus includes two half-electrode pieces formed by diving each electrode of electrode group on the counter electrode side out of the electrode groups vertically to a paper feed direction, and times of applying a potential to the half-electrode pieces in order to project the toner at a certain angle in a direction vertical to the toner carrier and the counter electrode.

6 Claims, 12 Drawing Sheets

| | ① | ② | ③ | ④ | ① | ② | ③ | ④ |
|---|---|---|---|---|---|---|---|---|
| L 2 | 0 | 0 | VO | VO | 0 | 0 | VO | VO |
| L 1 | 0 | 0 | | VO | 0 | 0 | | VO |
| R 1 | VO | | 0 | 0 | VO | | 0 | 0 |
| R 2 | VO | VO | 0 | 0 | VO | VO | 0 | 0 |

A BLANK COLUMN SHOWS A FLOAT STATE.

FIG. 12

| PRINTING POSITION (FIG. 11) | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| TONER DEFLECTING DIRECTION | ① | ② | ③ | ④ | ① | ② | ③ | ④ | ① | ② | ③ | ④ | ① | ② | ③ | ④ |
| RING-LIKE ELECTRODE | OFF | OFF | OFF | ON | OFF | OFF | OFF | ON | OFF | ON | OFF | ON | OFF | OFF | OFF | ON |
| PRINTING OR NOT | | | | ○ | | | | ○ | | ○ | | ○ | | | | ○ |

IMAGE FORMING APPARATUS

BACKGROUND OF THE INVENTION

1. Field of the Invention

The present invention relates to an image forming apparatus which is applicable to printing sections of digital copying machines, and to facsimile machines, digital printers, plotters and the like, and forms an image on a recording medium by projecting a toner.

2. Description of the Related Art

In recent years, there has been proposed an image forming apparatus which converts image signals into a visible image and outputs the onto a recording medium such as paper. To give an example, Japanese Examined Patent Publication JP-A 6-30901(1994) discloses an image forming apparatus which forms a toner image directly on a recording medium such as paper without temporarily forming the toner image on a photoreceptor. The image forming apparatus is constructed in the following manner; more specifically, a particle carrier for carrying a toner, and a rear electrode facing the toner carrier, that is, a counter electrode, are arranged with an interval, and an electrode matrix, which functions as a control electrode, is interposed between the toner carrier and the counter electrode. The aforesaid image forming apparatus generates an electric field between the toner carrier and the counter electrode so that the toner is projected from the toner carrier toward the counter electrode, and controls the projection of the toner by means of the control electrode, and thus, forms a toner image directly on a recording medium provided on a side of the counter electrode which faces the toner carrier.

The control electrode is classified into a so-called single drive type and a so-called matrix drive type. The control electrode of single drive type is constructed in a manner that a plurality of gates having an aperture are formed on an insulating substrate, and a ring-like electrode is provided on an edge portion of each gate of the insulating substrate. On the other hand, the control electrode of matrix drive type is constructed in a manner that strip-like electrodes having a plurality of apertures serving as gate inlet and outlet are arranged by plural ones on both sides of an insulating substrate having a plurality of holes acting as gates, and that strip-like electrodes on both sides of the insulating substrate cross each other at right angles.

Further, an image forming apparatus having the same system as disclosed in Japanese Examined Patent Publication No. 6-30901 (1994) has been disclosed in Japanese Unexamined Patent Publication No. 4-189555 (1992). The image forming apparatus is constructed in a manner that a toner supply roller serving as a toner carrier and a base electrode serving as a counter electrode are arranged with an interval, and that toner control means serving as the single-drive type control electrode is interposed between the toner carrier and the counter electrode. The toner control means is constructed in a manner that a pair of electrodes generating an electric field for passing the toner through the gate are provided in the vicinity of each of plural gates formed on both sides of the insulating substrate, and out of the pair of electrodes, the outlet-side electrode for passing the toner through the gate is divided into two in a feeding direction of the recording medium. With the feed of the recording medium, the image forming apparatus sequentially or selectively applies a voltage between the inlet-side electrode for passing the toner through the gate and the divided electrode on an upstream side of the feeding direction of recording medium, between the inlet-side electrode and the both divided electrodes, and between the inlet-side electrode and the divided electrode on a downstream side of the feeding direction of recording medium, and then forms a toner image directly on the recording medium.

The aforesaid two Publications describe a technique of controlling the projection of the toner by the control electrode, and forming a toner image directly on a recording medium. However, the image forming apparatuses disclosed in the both Publication are different in construction and structure from the present invention, and have many problems which will be described below.

The single-drive type control electrode has a construction such that ring-like electrodes are arranged on edge portions of the plurality of gates having plural apertures in the insulating substrate. For this reason, there is required control circuit means for applying predetermined potentials to the electrodes in the vicinities of the gates corresponding to image data. The number of control circuit means must make one-to-one correspondence with respect to each gate, or more.

For example, in the image forming apparatus which longitudinally feeds a recording medium such as letter paper having a side of 8.5×11 inch, the resolution is 300 DPI, and the number of gates is 2560. For this reason, there is required at least 2560 high-voltage FETs for controlling a potential of each gate.

As seen from the above explanation, in order to construct the control circuit, electronic components such as a high-voltage FET, a resistor, a capacitor or the like are required for each gate; for this reason, this causes an increase in cost. Further, a power source for operating many electronic components is required; for this reason, the capacity of power source is increased. Furthermore, the control electrode is equipped with a great many FETs; for this reason, a pattern wiring of the control electrode becomes complicated, and this is a factor of making large the control electrode. As a result, there arise problems of making large the image forming apparatus, and of making complicated a method of incorporating the control electrode into the image forming apparatus or a method of replacing the control electrode. Further, in the case of trying to improve a printing resolution, there is a geometrical limit in routing a pattern wire in the vicinity of the gate. For this reason, it is difficult to provide an image forming apparatus which can form an image having high resolution.

The matrix-drive type control electrode is constructed in a manner that a plurality of upper and lower strip-like electrodes, which have plural apertures serving as gate inlets and outlets on both sides of the insulating substrate having plural holes, are arranged so as to cross each other at right angles. During printing, the upper and lower strip-like electrodes serving as inlet and an outlet of one arbitrary gate are in a state that a potential for blocking the projection of the toner toward the lower strip-like electrode (hereinafter, referred to as OFF-potential) is applied, and a potential for projecting the toner toward the upper strip-like electrode (hereinafter, referred to as ON-potential) is applied, or a state that the OFF-potential is applied to the upper strip-like electrode and the ON-potential is applied to the lower strip-like electrode. At this time, the projection of the toner is not sufficiently blocked, and then, the toner adheres onto a undesired position in an image to be formed, causing the so-called fog. As a result, a high contrast image cannot be obtained. Further, according to the construction of the control electrode, strip-like electrodes are arranged on both sides of the insulating substrate; for this reason, the thickness of the control electrode is made thicker. This increases the possibility that the toner passing through the gate is jammed in the hole. Also, a void (where the toner image is not transferred) is caused in a portion of the image formed in the latter half of the image forming process.

In the system of controlling the projection of toner by means of the control electrode and forming the toner image directly on the recording medium, a gate hole needs to have a diameter which is at least equal to a printing dot diameter or more, and in addition, ring-like electrodes must be arranged on the edge portions of the gates. In the case of providing the gates on the control electrode, for geometrical reasons, the plurality of gates must be arranged obliquely to the feeding direction of recording medium, and the toner carrier must have a sufficient width vertical to a longitudinally vertical direction. For example, it is impossible to arrange the plurality of gates in line in the longitudinally vertical direction of the toner carrier. In the case of printing a solid black image pattern, the following phenomenon occurs: even if an electric field is generated in order for the toner to pass through the gate on a portion adjacent to the projection track on the toner carrier of the toner having first passed through one of gates, there is no sufficient toner on the toner carrier; for this reason, white streaks are caused in the solid black image.

Further, the plurality of gates of the control electrode are arranged in the circumferential direction of the toner carrier, and the toner carrier has a cylindrical shape and curvature. For this reason, when the gate is separated from the nearest position to the toner carrier in the insulating substrate, a distance between the toner carrier and the gate becomes great, and then, a difference occurs in the influence of the electric field generated by ring-like electrodes on the edge portion of the gate on the toner layer of the toner carrier. For this reason, there occurs a change in the projection amount of the toner passing through the gate; as a result, inconsistencies are caused in toner density.

Since Japanese Unexamined Patent Publication JP-A 4-189555 (1992) is directed to printing an image in uniform toner density and improving graduations by providing a pair of electrodes which generate an electric field for passing the toner through a gate on both sides of a control electrode, dividing an electrode on an outlet side of the gate where the toner passed through, into two in a feeding direction of a recording medium, and further, with the feed of the recording medium, deflecting the toner which passed through the gate, in the feeding direction of the recording medium, to form a dot on the same position of the recording medium. However, even if such technique is applied to an image forming apparatus, it is impossible to solve the aforesaid problems.

SUMMARY OF THE INVENTION

An object of the invention is to provide an image forming apparatus which includes a control electrode of simple structure for forming a toner image directly on a recording medium, and can form an image having high resolution on the recording medium.

In a first aspect of the invention, an image forming apparatus at least comprises:

supply means having a toner carrier for carrying toner;

a counter electrode arranged to face the toner carrier; and control means including:

a control electrode composed of an insulating substrate disposed between the toner carrier and the counter electrode, a plurality of gates provided in the insulating substrate as toner passages, and two-layer electrode groups composed of a plurality of electrodes individually provided on peripheries of the plurality of gates, and control circuit means capable of applying at least a predetermined potential corresponding to image data to individual electrodes of the control electrode, the image forming apparatus controlling the passage of toner through the plurality of gates by applying the predetermined potential to the electrodes of each electrode group by the control means to form an image on a surface of a recording medium fed between the control electrode and the counter electrode, wherein in order to project the toner at a certain angle from a direction vertical to the toner carrier and the counter electrode, two half-electrode pieces are formed by diving each electrode of electrode group on the counter electrode side out of the electrode groups vertically to a paper feed direction, and times for applying a potential to the half-electrode pieces are different.

In a second aspect of the invention, an image forming apparatus at least comprises:

supply means having a toner carrier for carrying toner;

a counter electrode arranged to face the toner carrier; and control means including:

a control electrode composed of an insulating substrate disposed between the toner carrier and the counter electrode, a plurality of gates provided in the insulating substrate as toner passages, and two-layer electrode groups composed of a plurality of electrodes individually provided on peripheries of the plurality of gates, and control circuit means capable of applying at least a predetermined potential corresponding to image data to individual electrodes of the control electrode, the image forming apparatus controlling the passage of toner through the plurality of gates by applying the predetermined potential to the electrodes of each electrode group by the control means to form an image on a surface of a recording medium fed between the control electrode and the counter electrode, wherein in order to project the toner at a certain angle from a direction vertical to the toner carrier and the counter electrode, two half-electrode pieces are formed by diving each electrode of electrode group on the counter electrode side out of the electrode groups vertically to a paper feed direction, a plurality of electrode pieces are further provided sequentially in a direction parallel to the paper feed direction with respect to each gate, and a position where a potential is applied is shifted among the two half-electrode pieces and the plurality of electrode pieces.

According to the first and second aspects of the invention, the image forming apparatus generates an electric field in a direction vertical to the toner carrier and the counter electrode by means of the electrode group of the control electrode on the counter electrode side. Whereby it is possible to successively form a plurality of dots on the surface of the recording medium with the use of one gate. Therefore, as compared with the image forming apparatus in the prior art, it is possible to considerably reduce the number of gates, and to reduce the number of electric components such as a high voltage FET, a resistor, and a capacitor which controls a potential of the gate, so that a large cost reduction can be achieved. Further, the number of high voltage FETs mounted on the control electrode is reduced, so that a pattern wiring of the control electrode can be simplified; therefore, the control electrode is made thinner. This serves to achieve miniaturization of the image forming apparatus and to readily incorporate the control electrode into the image forming apparatus. As a result, the printing resolution can be theoretically made higher.

In the case where the control electrode is the matrix drive type, during image formation, fog is not caused in a state that the ON-potential is applied to the upper strip-like electrode and the OFF-potential is applied to the lower strip-like electrode, or in a state that the OFF-potential is applied to the upper strip-like electrode and the ON-potential is applied to the lower strip-like electrode. Therefore, a preferable image having high contrast can be obtained. Further, it is possible to always project the toner when there is sufficient toner on the toner carrier. This serves to prevent occurrence of thin and white lengthwise lines in a solid black image, which is one of problems with the system of controlling the project of the toner by means of the control electrode and of forming the toner image directly on the recording medium. In addition, it is possible to geometrically arrange the gates on the control electrode in line in the direction vertically to the longitudinal direction of the toner carrier. Therefore, there doesn't occur a difference in the distance between the gate and the toner carrier from the influence of curvature, and nonuniformity in density is not caused, so that a preferable image can be obtained.

In a third aspect of the invention, among all of the half-electrode pieces and the electrode pieces of the image forming apparatus according to the first or second aspect, pieces which are situated in corresponding positions to each other in relation to the gates are connected to each other.

According to the third aspect of the invention, the image forming apparatus is constructed in such a manner that electrodes arranged in the corresponding positions to each other in relation to the gates in the electrode group on the counter electrode side are connected to each other. Thus, the same electric field is generated in each gate in a direction which is perpendicular to the direction vertical to the toner carrier and the counter electrode, and it is possible to stably project the toner to the target position on the recording medium and therefore a preferable image can be obtained.

In a fourth aspect of the invention, a voltage is always and successively applied to all the electrode pieces, and electrode group on the toner carrier side out of the electrode groups makes a decision either to project the toner or not to do so.

According to the fourth aspect, in the image forming apparatus, a voltage is always and successively applied to the half-electrode pieces formed by dividing the electrode group on the counter electrode into two and the electrode pieces, and the electrode group on the toner carrier side is controlled to decide on whether or not to project the toner. Thus, it is possible to control the electrode group on the counter electrode side out of the electrode groups by means of an electric circuit, so that a load to a CPU can be reduced. Further, it is possible to readily develop an algorithm when actually projecting the toner using a bitmap of printing image.

In a fifth aspect of the invention, the control circuit means makes a time of applying the predetermined potential longer as an angle formed by the projecting direction of the toner and the direction vertical to the toner carrier and the counter electrode is made wider.

According to the invention of the fifth aspect, the image forming apparatus determines the voltage application time in accordance with the projecting direction of the toner as described above. Thus, in the image forming apparatus, it is possible to vary the projecting direction of the toner only by controlling the time of applying a voltage, so that the projecting direction of the toner can be readily and securely controlled.

In a sixth aspect of the invention, the control circuit means makes shorter a distance between the pieces, among all of the half-electrode pieces and the electrode pieces, to which the predetermined potential is applied, as the angle formed by the projecting direction of the toner and the vertical to the toner carrier and the counter electrode direction is made wider.

According to the invention of the sixth aspect, the image forming apparatus selects two adjacent pieces from all the pieces as electrode pieces to which a voltage should be applied. Thus, in the image forming apparatus, by changing the two electrode pieces to which a voltage should be applied are changed on the basis of the relationship between the angle and the distance, it is possible to vary the project direction of the toner, so that the projecting direction of the toner can be readily and securely controlled.

BRIEF DESCRIPTION OF THE DRAWINGS

Other and further objects, features, and advantages of the invention will be more explicit from the following detailed description taken with reference to the drawings wherein:

FIG. 12 is a table showing a sequence of the image forming apparatus according to the first and second embodiments in the case of printing the image.

DETAILED DESCRIPTION OF THE PREFERRED EMBODIMENTS

Figure 1:
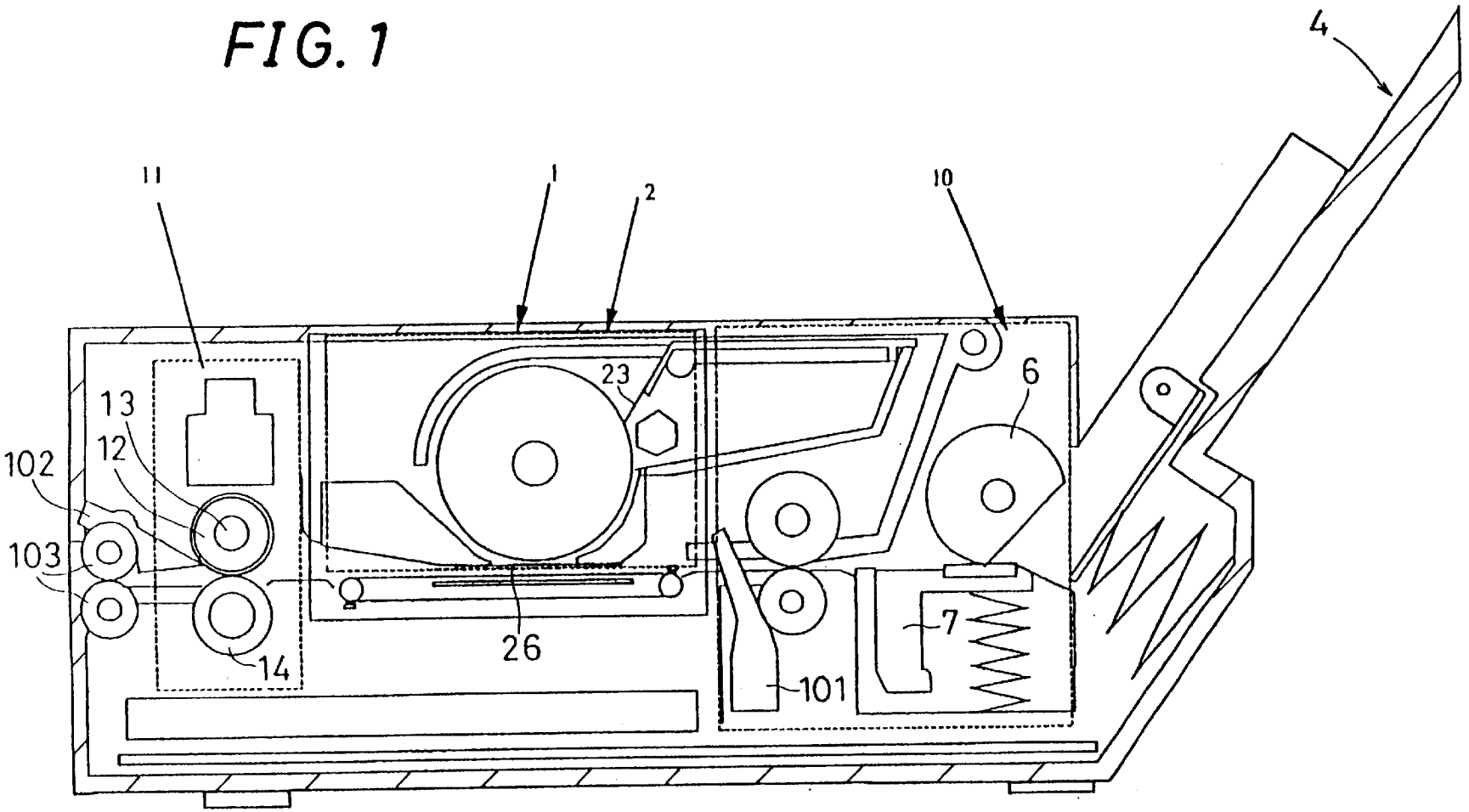
FIG. 1 is a cross-sectional view to explain a structure of a printer which uses an image forming apparatus according to a first embodiment of the invention as an image forming section.

Now referring to the drawings, preferred embodiments of the invention are described below.

FIG. 1 is a cross-sectional view of a printer which is equipped with an image forming apparatus according to a first embodiment as an image forming section 1, and an outline of elements will be described below with reference to both FIG. 1 and FIG. 2. In the description below, an image forming apparatus having a construction for handling a negative charged toner will be described in detail. However, in the case of using positive charged toner, a polarity of applied voltage may be properly set as the need arises.

A printer is provided with an image forming section 1 having a toner supply section 2 and a printing section 3. The image forming section 1 forms a toner image corresponding to an image signal on a recording medium, that is, on paper with the use of toner as a toner developer. More specifically, in the image forming apparatus, the toner is projected so as to adhere onto the paper, and the projection of toner is controlled on the basis of the image signal, and thus, an image is formed directly on the paper. The printer comprises a paper feeder and a fixing section 11 in addition to the image forming section 1.

On a side of putting the paper into the image forming section, the paper feeder 10 is provided. The paper feeder 10 comprises a paper cassette 4 storing paper 5 used as a recording medium, a pick-up roller 6 for feeding the paper 5 from the paper cassette 4, and a paper feed guide 7 for guiding the fed paper 5. Further, the paper feeder 10 has a paper feed sensor 101 which makes a detection that the paper 5 has been fed. The pick-up roller 6 is driven to rotate by means of a driving system (not shown).

Moreover, on a side of discharging the paper from the image forming section 1, there is provided the fixing section 11 for fixing a toner image, which is formed on the paper 5 in the image forming section 1, on the paper 5 by the application of heat and pressure. The fixing section 11 comprises a heating roller 12, a heater 13, a pressing roller 14, a temperature sensor 15, and a temperature control circuit 80. The heating roller 12 comprises an aluminum tube having a thickness of 2 mm. The heater 13 comprises a halogen lamp, for example, and is included in the heating roller 12. The pressing roller 14 is made of a silicon resin. In order to press the paper 5 between the heating roller 12 and the pressing roller 14, which oppose to each other, a load of e.g., 2 kg is applied to these rollers 12 and 14 by means of a spring or the like (not shown) on both sides of their respective shafts.

The temperature sensor 15 measures a surface temperature of the heating roller 12. The temperature control circuit 80 is controlled by a main control section, and controls the ON/OFF of heater 13 on the basis of the measured result of the temperature sensor so that the surface temperature of the heating roller 12 is kept at e.g., 150° C. The fixing section 11 is provided with a paper discharge sensor 102 which makes a detection that the paper 5 has been discharged. Also, the materials for these heating roller 12, heater 13, pressing roller 14 and the like are not specially limited.

The surface temperature of the heating roller 12 is not specially limited. Further, the fixing section 11 may be constructed in such a manner as to fix a toner image by heating or pressing the paper 5.

On the side of discharging the paper from the fixing section 11, there are a paper discharge roller 103 which discharges the paper 5 having processed in the fixing section 11 onto a paper discharge tray, and the paper discharge tray which receives the discharged paper 5. The heating roller 12, the pressing roller 14 and the discharge roller 103 are driven to rotate by a driving mechanism not illustrated.

The toner supply section 2 of the image forming section 1 comprises a toner storage tank 20 for storing the toner 21 used as a developer, a toner carrier 22 which functions as a cylindrical carrier (sleeve) for carrying the toner 21 by a magnetic force, and a doctor blade 23 which is located in the toner storage tank 20, and charges the toner 21 while restricting a thickness of a toner layer carried on an outer circumferential surface of the toner carrier 22. The doctor blade 23 is provided on an upstream side in a rotating direction of the toner carrier 22 so that a distance between the doctor blade 23 and the outer circumferential surface of the toner carrier 22 is set to e.g., 60 $\mu$m. The toner 21 is, for example, magnetic toner having an average particle diameter of 6 $\mu$m, and a charge is given to the toner 21 by means of the doctor blade 23 so that a charged rate is within −4 $\mu$C/g to −5 $\mu$C/g.

The distance between the doctor blade 23 and the toner carrier 22 is not specially limited. Further, the average particle diameter J and charged of the toner 21 are not specially limited.

Figure 2:
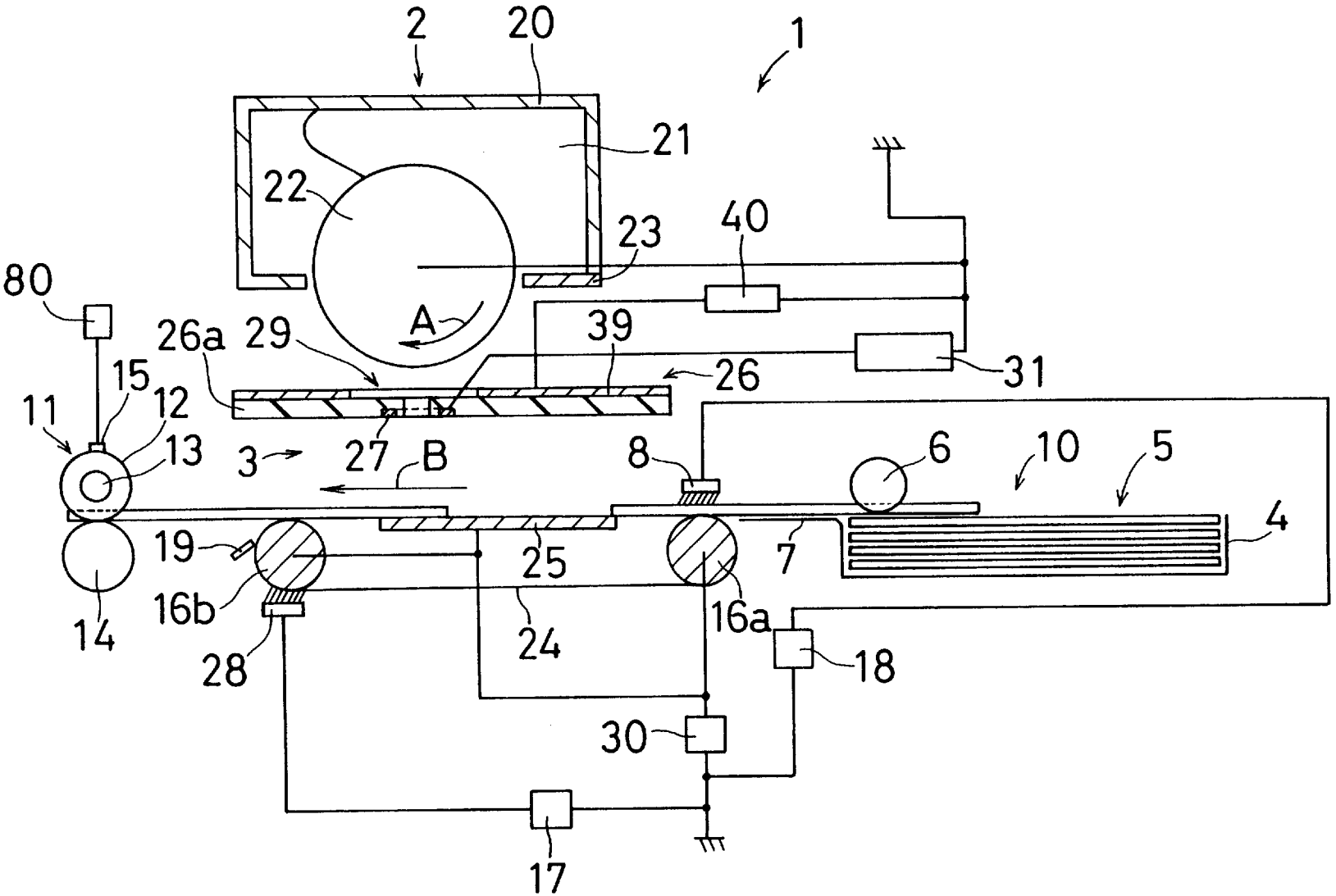
FIG. 2 is a cross-sectional view to explain principal parts of the image forming apparatus according to the first embodiment.

The toner carrier 22 is driven by means of a driving mechanism (not shown) to rotate in a direction indicated by an arrow of FIG. 2 at a speed of 80 mm/sec on its surface. Further, the toner carrier 22 is grounded, and a magnet (not shown) is arranged in each of a position facing the doctor blade 23 in the toner carrier 22 and a position facing a control electrode 26 which will be described later. Whereby the toner carrier 22 can carry the toner 21 on the outer circumferential surface thereof. Also, the toner 21 carried on the outer circumferential surface of the toner carrier 22 stands up in positions corresponding to the aforesaid positions on the outer circumferential surface thereof. The rotational speed of the toner carrier 22 is not specially limited. Further, the toner carrier 22 may carry the toner 21 by an electric force or by an electric force and a magnetic force in place of a magnetic force.

The printing section 3 of the image forming section 1 comprises, for example, an aluminum sheet-plate having a thickness of 1 mm. Further, the printing section is equipped with a counter electrode 25 facing the outer circumferential surface of the toner carrier 22, a high pressure power source 30 for supplying a high pressure to the counter electrode 25, a control electrode 26 which is provided between the toner carrier 22 and the counter electrode, a discharger brush 28, a discharger power source 17 for giving a discharge potential to the discharger brush 28, a charger brush 8 for charging the paper 5, a charger power source 18 for giving a charge potential to the charger brush 8, a dielectric belt 24, support members 16*a* and 16*b* for supporting the dielectric belt 24, and a cleaner blade 19. The counter electrode 25 is located so that a distance between the outer circumferential surface of the toner carrier 22 and the counter electrode 25 is set to e.g., 1.1 mm. The dielectric belt 24 is made of a PVDF as a base material, and has a volume resistivity of 1010 Ω·cm and a thickness of 75 μm. Further, the dielectric belt 24 is driven by means of a driving mechanism (not shown) as to rotate in a direction indicated by an arrow B of FIG. 2 at a speed of 30 mm/sec on the surface, for example. Also, a high pressure of e.g., 2.3 kV is applied to the counter electrode 25 by means of a high pressure power source 30 which functions as control means. More specifically, between the counter electrode 25 and the toner carrier 22, there is given an electric field required for projecting the toner 21 carried on the toner carrier 22 toward the counter electrode 25 by the high pressure applied from the high pressure power source 30.

The discharger brush 28 is disposed on a downstream side of the control electrode 26 in the rotating direction of the dielectric belt 24 so as to be pressed against the dielectric belt 24 and to contact therewith. A discharge potential of 2.5 kV is applied to the discharger brush 28 by means of the discharger power source 17 so as to discharge unnecessary charges existing on the surface of the dielectric belt 24.

For example, in the case where accidents such as paper jam and the like occur and the toner 21 adheres onto the surface of the dielectric belt 24, the cleaning blade 19 removes the adhered toner 21 so as to prevent a back side of paper from being contaminated with the toner 21. Also, a material for the counter electrode 25 is not specially limited. Further, the distance between the counter electrode 25 and the toner carrier 22 is not specially limited. Furthermore, the rotational speed of the counter electrode 25 and an applied voltage are not specially limited.

The image forming apparatus is further provided with a main control section which functions as a control circuit and controls the entirety of image forming apparatus, a image processing section which converts an image data given from devices external to the printer into a form of image data to be printed, an image memory which stores the converted image data, and an image forming control unit which converts the image data obtained from the image processing section into an image data to be given to the control electrode 26.

The control electrode 26 is parallel with a tangential direction of the counter electrode 25 surface, and is two-dimensionally extended in a state of facing the counter electrode 25. Further, the control electrode 26 has a structure such that a toner flow from the toner carrier 22 toward the counter electrode 25 can pass therethrough. And then, an electric field given between the toner carrier 22 and the counter electrode 25 is varied according to a potential supplied to the control electrode 26, and thereby the projection of toner 21 from the toner carrier 22 to the counter electrode 25 is controlled.

Moreover, the control electrode 26 is located so that a distance between the outer circumferential surface of the toner carrier 22 and the control electrode 26 is set to e.g., 100 μm, and is supported by means of a support member (not shown). As shown in FIG. 4, the control electrode 26 comprises an insulating substrate 26*a*, a high voltage driver (not shown), individually independent ring-like conductors, that is, ring-like electrodes 27, first ring-like right-half-electrode pieces 32 and a first ring-like left-half-electrode pieces 33 which are formed by dividing the ring-like conductor into half. The substrate 26*a* is made of e.g., a polyimide resin, and is formed so as to have a thickness of 25 μm.

Figure 4A:
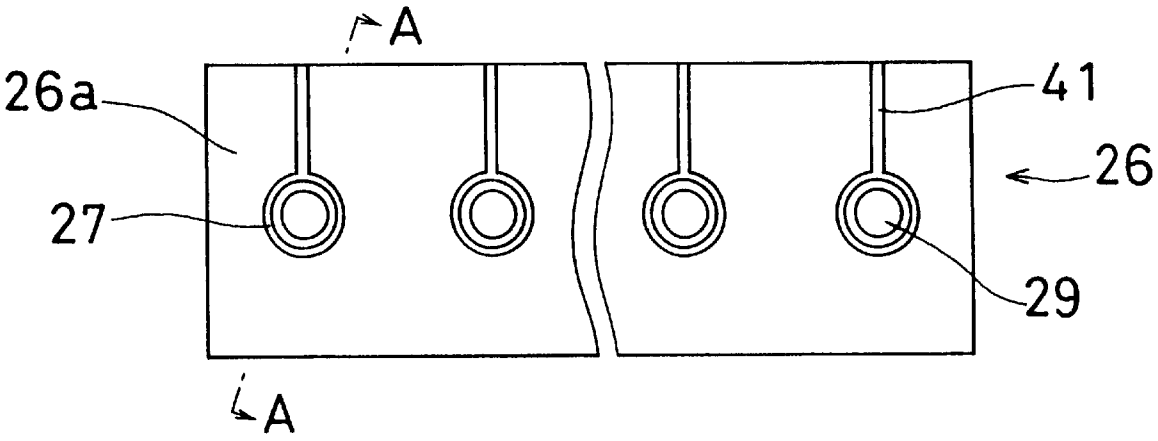
FIG. 4A is a top plan view showing one side of a control electrode 26 on a toner carrier side in the image forming apparatus according to the first embodiment.
Figure 4B:
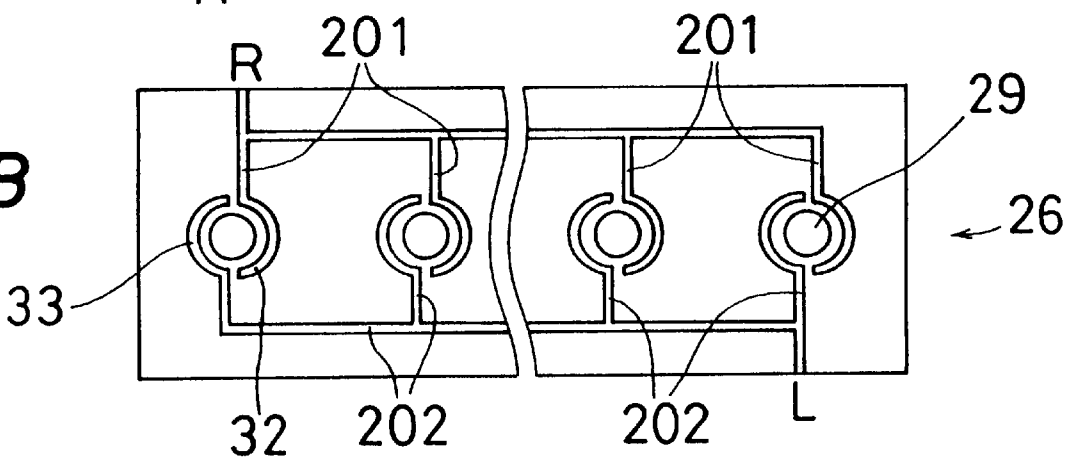
FIG. 4B is a bottom view showing the other side of the control electrode 26 on a counter electrode side in the image forming apparatus according to the first embodiment.
Figure 4C:
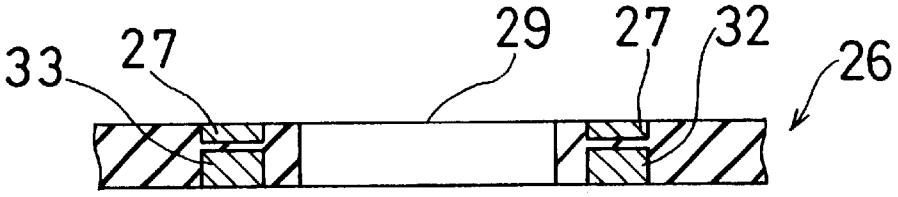
FIG. 4C is an enlarged cross-sectional view as cut along a line A—A of FIG. 4A, showing the control electrode 26 of the image forming apparatus according to the first embodiment.

As shown in FIG. 4A to FIG. 4C, the substrate 26*a* is formed with a plurality of holes which serve as a part of a gate 29 described later. The plurality of holes are arranged in line and parallel to a direction perpendicular to a feeding direction of the paper in a state that the control electrode 26 is fixed to the image forming section 1. Each of the ring-like electrodes 27 is constructed of a copper foil having a thickness of e.g., 18 μm, and are arranged so that an aperture on one side of the substrate 26*a* is put in an aperture of each ring-like electrode 27. Further, on the other side of the substrate 26*a*, there is provided a shield electrode 39 which is formed with a plurality of apertures. The shield electrode 39 is disposed so that each aperture on the other side of the substrate 26*a* faces each aperture of the shield electrode 39. The first ring-like right-half-electrode pieces 32 and the first ring-like left-half-electrode pieces 33 individually comprise a copper foil having a thickness of 50 μm, and are arranged on the peripheries of the apertures on the other side according to a predetermined layout. Also, each aperture is formed so as to have a diameter of 160 μm, and serves as a section for passing the toner 21 projected from the toner carrier 22 to the counter electrode 25. This passing section is hereinafter referred to as a gate 29.

The distance between the control electrode 26 and the toner carrier 22 is not specially limited. Each of ring-like electrodes 27 is formed with an aperture having an diameter of 200 μm. Further, the size of gates 29, and materials for and thickness of the substrate 26*a* and ring-like electrodes 27 are not specially limited.

The number of formed gates 29 is 640, for example, and also the ring-like electrodes 27 are formed by the same number as the gates 29. These ring-like electrodes 27 are electrically connected to a control power source section 31 via power supply wires 41 and a high voltage driver (not shown). The number of the ring-like electrodes 27 is not specially limited.

The surfaces of the ring-like electrodes 27 and the surfaces of the power supply wires 41 are covered with an insulating layer 26*b* (described later) having a thickness of 30 μm. This serves to secure insulation between ring-like electrodes 27, insulation between power supply wires 41, insulation between ring-like electrodes 27 and power supply wires 41 which are connected to each other. Insulation is also established between the ring-like electrode 27 and the toner carrier 22, between the toner supply wires 41 and the toner carrier 22, between the ring-like electrodes 27 and the counter electrode 25, and between the toner supply wires 41 and the counter electrode 25. The material for and thickness of the insulating layer are not specially limited. A pulse in response to an image signal, that is, a voltage is applied to the ring-like electrodes 27 of the control electrode 26 by means of the control power source section 31 which functions as one of control means. More specifically, the control power source section 31 applies a voltage of 150 V, for example, to the ring-like electrodes 27 in the case of passing the toner 21 carried on the toner carrier 22 toward the counter electrode 25, and applies a voltage of −200 V, for example, thereto in the case of blocking the passage of the toner 21.

A shield potential of −200 V is supplied from a shield power source 40 to the shield electrode 39 disposed on the control electrode 26. Whereby the shield electrode 39 has the effect of preventing the toner from adhering to the control electrode 26, or removing the toner 21 adhered to the electrode 26 from the toner carrier 22.

In the manner as described above, when the potential applied to the control electrode 26 is controlled in accordance with the image signal, and the paper 5 is fed to the side of counter electrode 25 facing the toner carrier 22, a toner image in response to the image signal is formed on the surface of the paper 5. Also, the control power source section 31 is controlled by a control electrode controlling signal transmitted from the image forming control unit (not shown).

Figure 3:
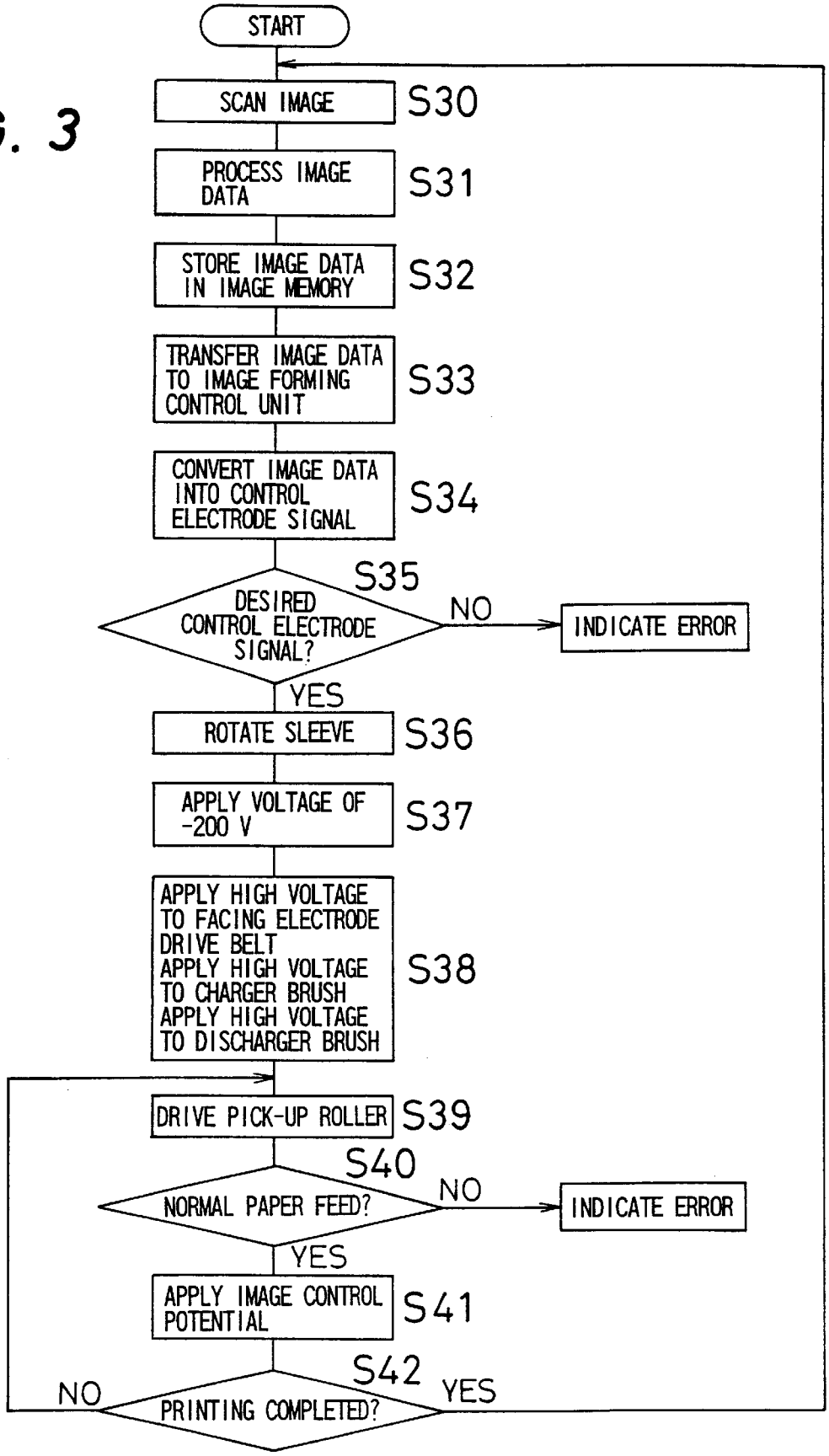
FIG. 3 is a diagram to explain an operation of the image forming apparatus according to the first embodiment.

The image forming apparatus is applicable to a printer for producing output from a computer or a word processor, and also, is applicable to a printing section of a digital copying machine. Next, the following is a description on an image forming operation in the case where the image forming apparatus is used as the printing section of a digital copying machine referring to FIG. 3.

First, when a manuscript to be copied is placed on a image scanner section and a copy start button (not shown) is operated, a main control section receiving this input starts an image forming operation. More specifically, in step S30, the manuscript image is read by means of the image scanner section, and then, in step S31, the image data is processed in the image processing section, and thus, is stored in an image memory in step S32. In step S33, the image data is transferred to the image forming control unit. In step S34, the image forming control unit starts to convert the inputted image data into a control electrode controlling signal to be given to the control electrode 26.

Next, in step S35, the image forming control unit makes a judgment on whether or not a predetermined amount of part of control electrode controlling signal has been obtained. In the case where the predetermined amount of part of the signal has not been obtained, an error indication is given. In the case where the predetermined amount of part of the signal has been obtained, in step S36, a driving mechanism (not shown) is actuated.

In step S36, the toner carrier 22 starts to rotate. In step S37, a predetermined voltage is applied to each of the counter electrode 25, the charger brush 8 and the discharger brush 28. Further, in steps S39, the pick-up roller 6 is driven to rotate by means of the driving mechanism. Whereupon the paper 5 stored in the paper cassette 4 is fed toward the image forming section 1, and simultaneously, in step S40, the paper feeder sensor makes a detection as to whether or not the paper is in a normal paper feed state. In the case where the paper feed state is abnormal, an error indication is given. On the other hand, in the case where the paper feed state is normal, the paper 5 fed by the pick-up roller 6 is transported between the charger brush 8 and the support member 16*a*. The same potential as the counter electrode 25 is applied to the support member 16*a* by means of the high voltage power source 30. A charged potential of 1.2 kV is applied to the charger brush 8 by means of the charger power source 18. When a charge by a potential difference between the charger brush 8 and the support member 16*a* is supplied to the paper 5, the electrostatically attracted paper is fed to a side facing the toner carrier 22 of the dielectric belt 24 in the printing section 3 of the image forming section 1. The predetermined amount of part of the control electrode controlling signal is different depending upon the construction of the image forming apparatus, or the like.

Thereafter, in step S41, the image forming control unit supplies the control electrode controlling signal to the control power source section 31. The supply of the control electrode controlling signal is carried out at timing synchronous with the time when the paper 5 is fed to the printing section 3 by means of the charger brush 8. The control power source section 31 controls a high voltage applied to ring-like electrodes of the control electrode 26 on the basis of the control electrode controlling signal. More specifically, a voltage of 150 V or −200 V is applied to predetermined ones of the ring-like electrodes 27 from the control power source section 31 as necessary, and then, an electric field in the vicinity of the control electrode 26 is controlled. In other words, in the gates 29 of the control electrode 26, the projection of the toner 21 from the toner carrier 22 to the counter electrode 25 is blocked or the blocking of the projection of the toner 21 is released as necessary according to image data. Whereby a toner image corresponding to the image signal is formed on the paper 5 which is being moved toward the paper discharge side at a speed of 30 mm/sec by the movement of the dielectric belt 24 on the counter electrode 25 surface.

The paper 5, on which the toner image has been formed, is separated from the dielectric belt 24 because of the curvature of the support member 16*b*, and is fed to the fixing section 11, and thereafter, the toner image is fixed to the paper 5 in the fixing section 11. Subsequently, the paper 5, on which the toner image has been fixed, is discharged onto the paper tray by means of the paper discharge roller, and then, the paper discharge sensor makes a detection that the paper 5 has been normally discharged. On the basis of the detective operation, in step S42, the main control section makes a judgment on whether or not a printing operation has normally completed. In the case where the printing operation has not completed, the sequence returns from step S42 to step S39. On the other hand, in the case where the printing operation has completed, one cycle of image forming process has ended, and the sequence returns from step S42 to step S30.

According to the aforesaid image forming operation, a preferable image is formed on the paper 5. The present image forming apparatus forms the image directly on the paper 5; therefore, it is possible to dispense a photoreceptor such as a dielectric drum or the like, used in the conventional image forming apparatus. Thus, since a transfer operation for transferring the image from the photoreceptor onto the paper 5 is omitted, image deterioration is not caused. This serves to improve the reliability of the apparatus. Further, the construction of the apparatus is simplified, and the number of components is reduced, so that a small-sized and inexpensive image forming apparatus can be provided.

Even in the case where the aforesaid image forming apparatus is used as a printing section of an output terminal for a computer or as a printing section of a digital copying machine, no difference is caused in the image forming method although there is a difference in the image signal to be processed and the signal exchanges.

As described before, the toner carrier 22 is grounded; on the other hand, a voltage of 2.3 kV is applied to the counter electrode 25 and the support member 16*a*, and a voltage of 1.2 kV is applied to the charger brush 8. Thus, by the potential difference between the charger brush 8 and the support member 16*a*, a negative charge is supplied to the surface of the paper 5 fed between the charger brush 8 and the dielectric belt 24. When the negative charge has been supplied, the paper 5, attracted to the dielectric belt 24 by a static force of the charge, is moved just under the gate 29 by the movement of the dielectric belt 24. A charge on the surface of the dielectric belt 24 is attenuated with time until the dielectric belt 24 reaches just under the gate 29. For this reason, the surface potential of the dielectric belt 24 becomes 2 kV in relation to the potential of the counter electrode 25.

In this state, in the case of passing the toner 21 carried on the toner carrier 22 through the gates 29 toward the counter electrode, a voltage of 150 V is applied to the ring-like electrodes 27 of the control electrode 26 by means of the control power source section 31, and in the case of blocking the passage of the toner 21 through the gates 29, a voltage of −200 V is applied to the same.

In the manner described above, the image forming apparatus forms an image directly on the paper 5 in a state that the paper 5 is attracted onto the dielectric belt 24. In the above description, there has been given an example showing the case where a potential of 150 V is applied to the ring-like electrodes 27 of the control electrode 26 to pass the toner 21 through the gates 29. The potential is not specially limited so long as the projection of the toner 21 is desirably controlled. Likewise, the potential applied to the counter electrode 25, the potential applied to the charger brush 8, and the potential on the surface of the paper 5 situated just under the gate 29 are not specially limited so long as the projection of the toner 21 is desirably controlled. Also, the potential applied to the ring-like electrodes 27 of the control electrode 26 to block the passage of the toner 21 is not specially limited within the scope of claims of the invention.

The following is a description on a method of projecting the toner 21 at a certain angle from a direction Y vertical to the toner carrier 22 and the counter electrode 25 in the image forming apparatus.

As shown in FIG. 4, the control electrode 26 is composed of the insulating substrate 26*a*, the high voltage driver, the ring-like electrodes 27 of ring-shaped conductors which are arranged in the vicinities of the gates 29 on the toner carrier 22 side, the first ring-like right-half-electrode pieces 32 and first ring-like left-half-electrode pieces 33 which have a shape of ring divided into half and are arranged in the vicinities of the gates 29 on the counter electrode 25 side.

Figure 5:
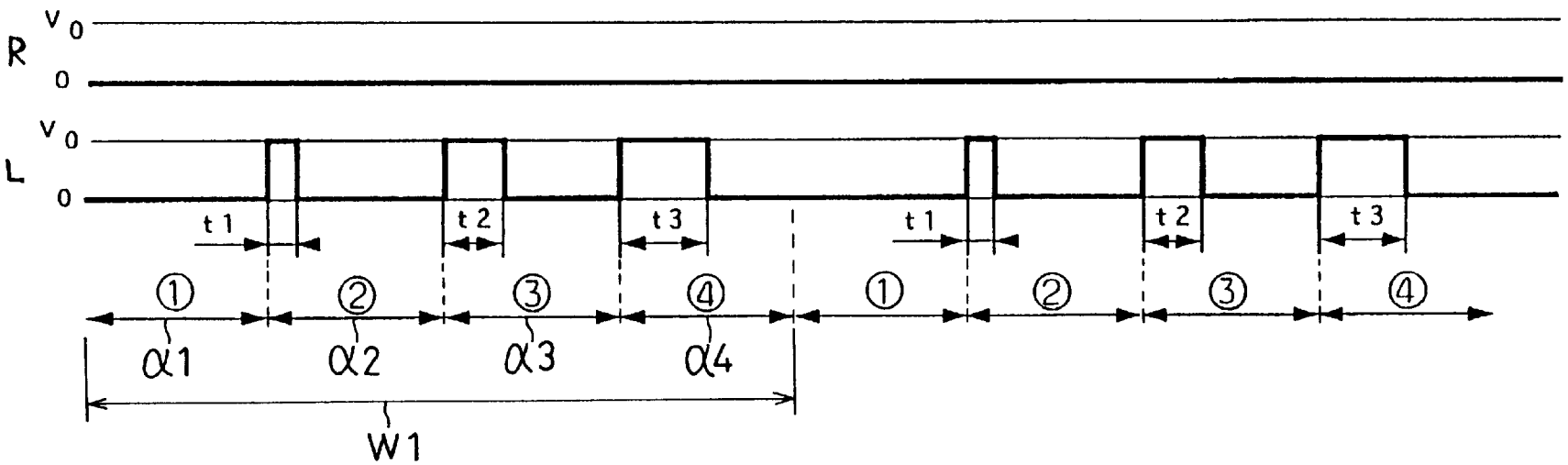
FIG. 5 is a timing chart to explain change timing of a potential applied to the control electrode 26 of the image forming apparatus according to the first embodiment.
Figure 6:
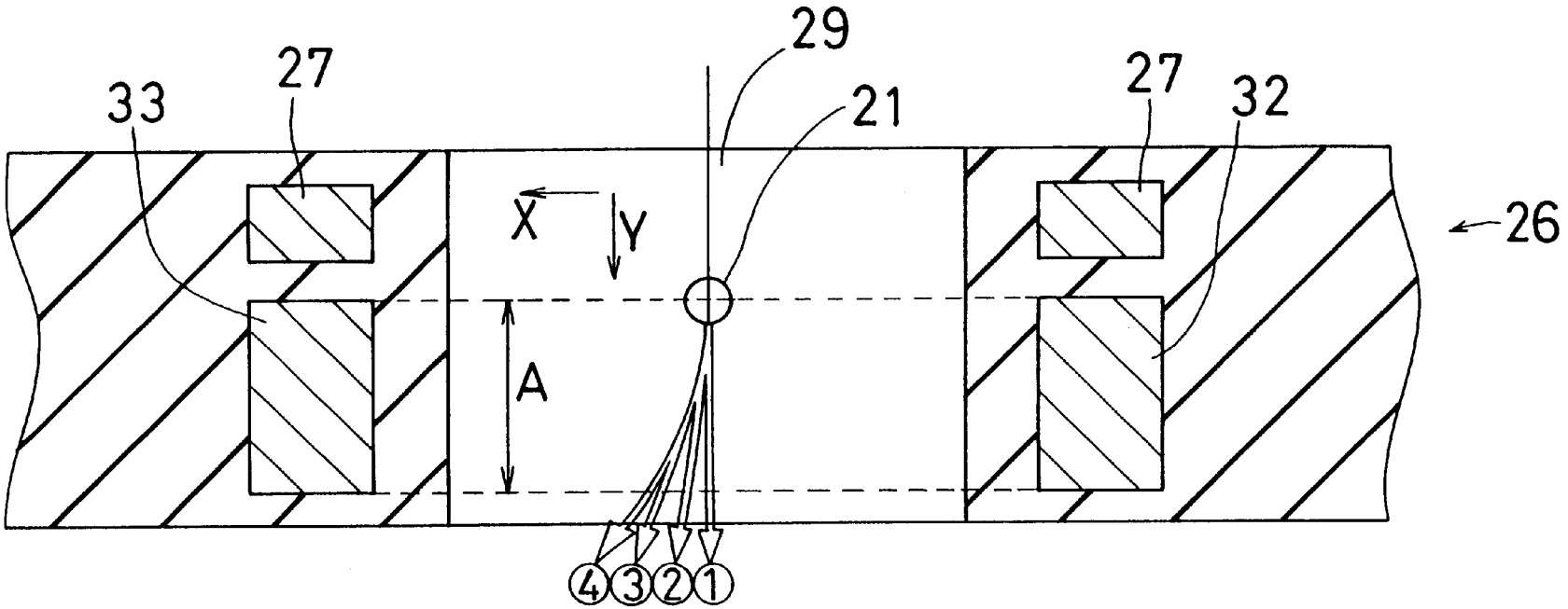
FIG. 6 is a view to explain a project (flight) trajectory of toner 21 in the image forming apparatus according to the first embodiment.

As shown in FIG. 6, 0V and V0 kV are applied to the first ring-like right-piece electrode 32 and the first ring-like left-half-electrode piece 33, respectively (see FIG. 5). And then, in a range A of the hole, there is formed an electric field E0 such that the toner 21 is attracted in an X direction. The X direction, for example, is parallel with the feed direction 33 of the paper 5.

The electric field E0 has a size obtained from the following equation (1) assuming that a distance between the first ring-like right-half-electrode piece 32 and the first ring-like left-half-electrode piece 33, is set as "d":

$$E0=V0/d \tag{1}$$

When the toner 21 is attracted, the toner 21 has no initial velocity; for this reason, air resistance may be disregarded. Thus, an equation of motion of the toner 21 in the X direction is expressed by the following equation (2):

$$m\cdot dv/dt=q\cdot E0 \tag{2}$$

wherein, m shows a toner mass, q is a toner charged rate, v shows a projection velocity component of the toner 21 in the X direction, and t shows time. Solving the equation (2) of motion to find the value "v" of the projection velocity component in the X direction, the following equation (3) is obtained.

$$V=(q/m)\cdot E0\cdot t \tag{3}$$

As a result, it is found that the projection velocity component of the toner 21 in the X direction is proportional to the time. Thus, a projecting direction of the toner 21 is determined by a resultant of a vector of the projection velocity component of the toner 21 in a Y direction and a vector of the projection velocity component of the toner 21 in the X direction obtained from the equation (3) at a timing of stopping the application of voltage to the first ring-like right-half-electrode piece 32 and the first ring-like left-half-electrode piece 33.

According to the aforesaid principle, a predetermined voltage V0 is applied to the first ring-like left-half-electrode piece 33 at timing L shown in a wave form diagram of FIG. 5 in the order of voltage application times t1, t2, t3 (t1<t2<t3). By doing so, the projecting direction of the toner 21 is deflected sequentially as shown by arrows ①, ②, ③ and ④. More specifically, the operation for applying a voltage to the first ring-like right-half-electrode piece 32 and the first ring-like left-half-electrode piece 33 is as described below , and the operation is repeated in a predetermined cycle W1. Also, in the voltage application operation during one cycle W1, the one cycle W1 is equally divided to establish first to fourth periods α1 to α4.

During one cycle W1, a voltage of 0V is always applied to the first ring-like right-half-electrode piece 32 as shown in the wave form diagram R of FIG. 5. On the other hand, a predetermined voltage V0 is applied to the first ring-like left-half-electrode piece 33 for each of the voltage application times t1 to t3 during each of the periods α1 to α4. The application time t0 is zero in FIG. 5, and the application times t1 to t3 becomes longer in the named order. More specifically, during one cycle, the predetermined voltage V0is applied to the first ring-like left-half-electrode piece 33 on plural occasions, and in the application times of the voltage, the later the timing of applying the voltage V0 is, the longer the application time is. As a result, the projecting direction of the toner 21 is deflected from the Y direction during one cycle. The image forming apparatus performs the printing operation with the use of the toner thus deflected.

The following is a description on an image forming apparatus according to a second embodiment of the invention. The image forming apparatus of this second embodiment is different from the image forming apparatus of the first embodiment in that the control electrode 26 and the section relative to the control of the control electrode 26 are replaced with a control electrode 126 and a section relative to the control of the control electrode 126, and otherwise it is the same as the image forming apparatus of the first embodiment. Therefore, in the image forming apparatus of the second embodiment, the same reference numerals are given to components identical to those of the image forming apparatus of the first embodiment, and the details thereof are omitted.

The following is a description on a method of projecting the toner 21 at a certain angle from a direction vertical to the toner carrier 22 and the counter electrode 25.

Figure 7A:
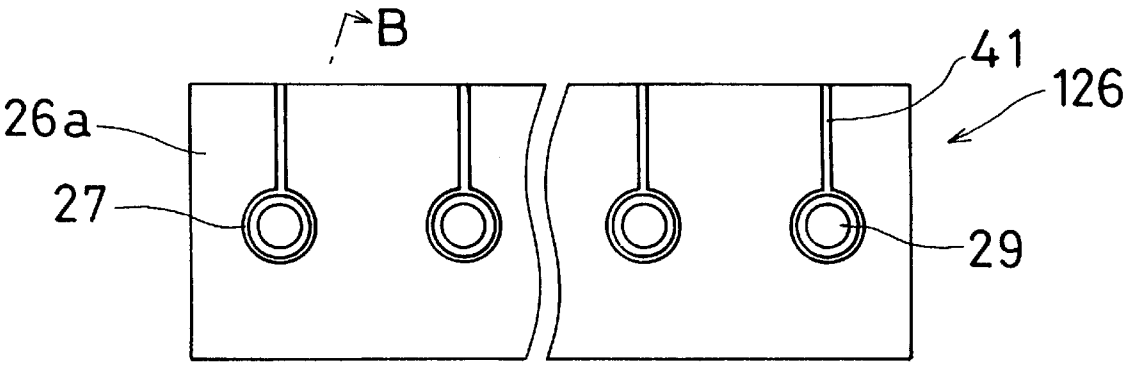
FIG. 7A is a top plan view showing one side of a control electrode 126 on a toner carrier side in the image forming apparatus according to a second embodiment of the invention.
Figure 7B:
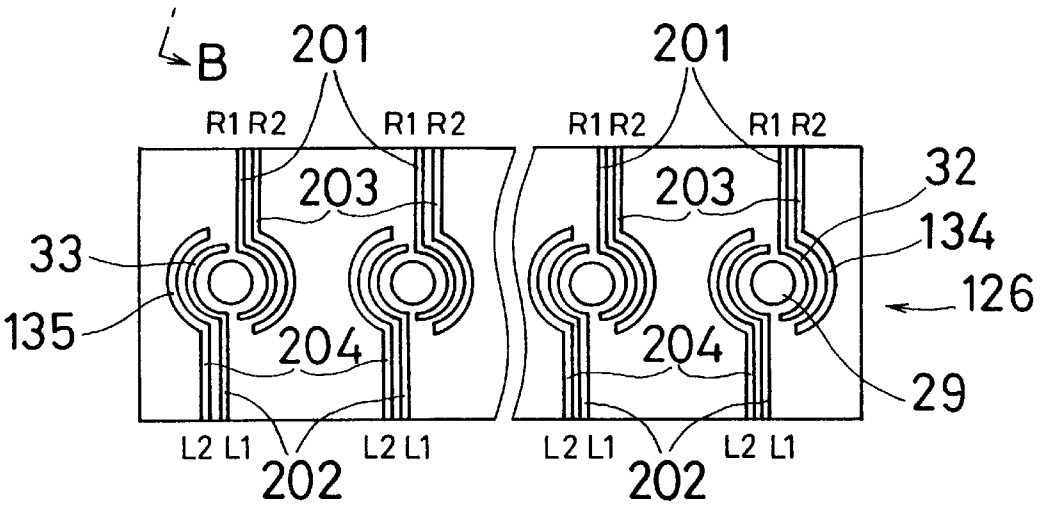
FIG. 7B is a bottom view showing the other side of the control electrode 126 on a counter electrode side in the image forming apparatus according to the second embodiment.
Figure 7C:
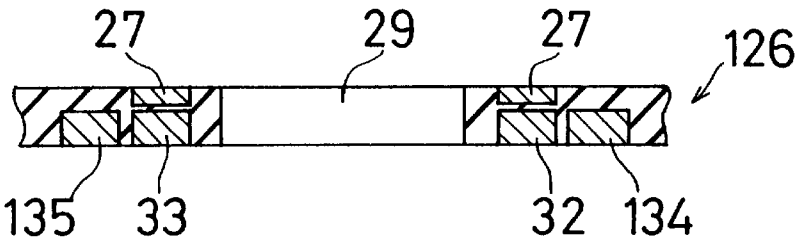
FIG. 7C is an enlarged cross-sectional view as cut along a line B—B of FIG. 7A, showing the control electrode 126 of the image forming apparatus according to the second embodiment.

As shown in FIG. 7, the control electrode 126 is composed of the insulating substrate 26*a*, the high voltage driver, the ring-like electrodes 27 of ring-shaped conductors which are arranged in the vicinities of the gates 29 on the toner carrier 22 side, the first ring-like right-half-electrode pieces 32 and the first ring-like left-half-electrode pieces 33 which have a shape of ring divided into half and are arranged in the vicinities of the gates 29 on the counter electrode 25 side.

Referring now to FIG. 9, the principle of deflecting the toner 21 will be described below. In order to deflect the toner 21, the control electrode 126 forms an electric field E0 in a range A in the gate such that the toner 21 is attracted in an X direction shown by an arrow or in a direction opposite to the x direction. The size of the electric field E0 is as shown in the equation (1). The projection velocity component of the toner 21 in the X direction is obtained from the equation (3) by solving the equation (2) of motion in the same manner as the description of FIG. 6.

More specifically, with combinations of the first ring-like right-half-electrode piece 32, the first ring-like left-half-electrode piece, the second ring-like right-half-electrode piece 134 and the second ring-like left-half-electrode piece 32, by selectively applying a voltage to these electrode pieces, a distance between two electrode pieces to which a voltage is applied, that is, the distance d of the equation (1) is varied so as to make a change to the electric field inversely proportional to the distance d. As a result, as shown in the equation (3), the projection velocity component of the toner 21 in the X direction has a relation proportional to the electric field, so that the toner projection velocity in the X direction component can be changed. The projecting direction of the toner 21 is determined by a resultant of a vector of projection velocity component of the toner 21 in the Y direction beyond the range A and a vector of projection velocity component in the X direction obtained from the equation (3). Whereby the toner 21 is deflected as shown by arrows ①, ②, ③ and ④, and then, the printing operation is performed.

Figure 8:
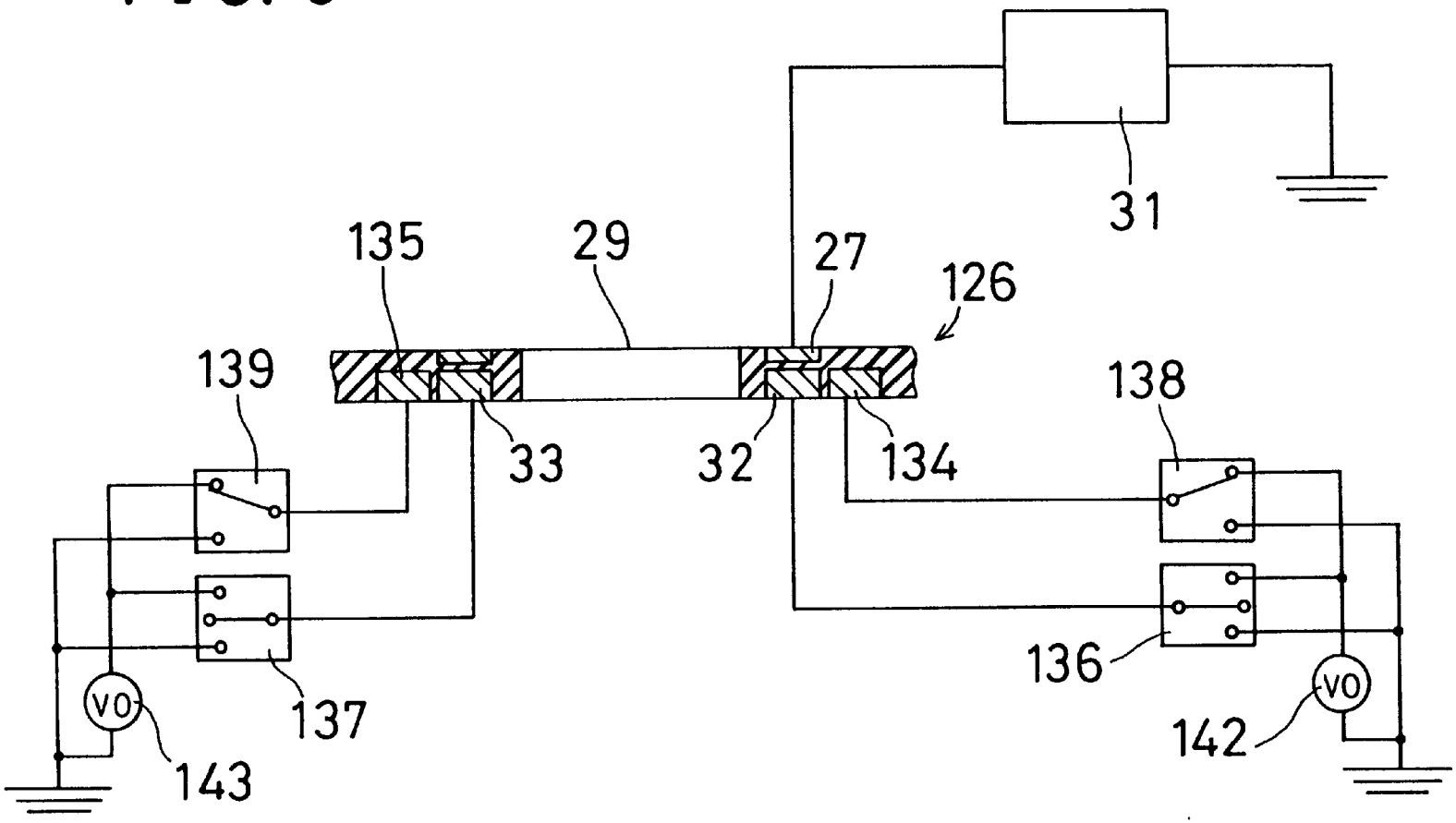
FIG. 8 is a view showing a wire connection state of the control electrode 126 and high voltage power sources 31, 142 and 143 in the image forming apparatus according to the second embodiment.
Figures 9A, 9B:
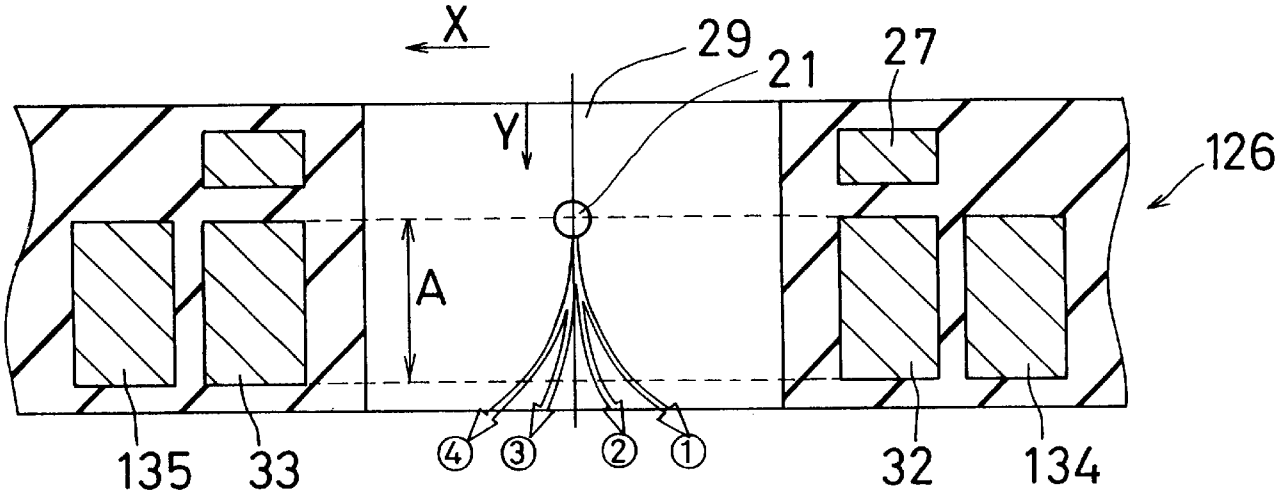
FIG. 9A is a table to explain a state of a potential applied to the control electrode 126 of the image forming apparatus according to the second embodiment.
FIG. 9B is a view to explain a projection track of the toner 21 in the image forming apparatus according to the second embodiment.

FIG. 8 shows a wiring diagram for supplying a voltage to the control electrode 126. The ring-like electrodes 27 are connected to the control electrode power source section 31, and a voltage for projecting the toner or a voltage for blocking the projection of the toner is applied thereto. The first ring-like right-half-electrode pieces 32 are connected to a reference power source 142 via a first ring-like electrode right switch 136, and becomes in either of a state that the voltage of 0V is applied, a state that the voltage of V0 kV is applied, and a float state. Also, the first ring-like left-half-electrode pieces 33 become in either of the aforesaid states in the same manner. Next, the second ring-like right-half-electrode pieces 134 are connected to the reference power source 142 via a second ring-like electrode right switch 138, and become in either of a state that the voltage of 0V is applied, and a state that the voltage of V0 kV is applied. Also, the second ring-like left-half-electrode pieces 135 become in either of the aforesaid states in the same manner. According to the wiring of FIG. 8, it is possible to readily generate states during periods ①, ②, ③ and ④ shown in a table of FIG. 9A by the changeover of the switches. Consequently, as shown in FIG. 9B, the toner 21 is deflected as shown by arrows ①, ②, ③ and ④.

More specifically, the operation for selectively applying a voltage to the first ring-like right-half-electrode pieces 32, the first ring-like left-half-electrode pieces 33, the second ring-like right-half-electrode pieces 134 and the second ring-like left-half-electrode pieces 135 is as described below. The operation is repeated in a predetermined cycle W1. Also, in the voltage application operation within one cycle W1, the one cycle W1 is equally divided to establish first to fourth periods ① to ④.

During the first and second periods ① and ②, the predetermined voltage V0is applied to the second ring-like right-half-electrode pieces 134, and during third and fourth periods ② and ④, the voltage of 0V is applied thereto. During the first period ①, the predetermined voltage V0is applied to the first ring-like right-half-electrode pieces 32, and then, the first ring-like right-half-electrode pieces 32 become in a float state during the second period ②, and further, the voltage of 0V is applied thereto during the third and fourth periods (③ and ④). During the first and second periods ① and ②, the voltage of 0V is applied to the first ring-like left-half-electrode pieces 33, and then, the first ring-like right-half-electrode pieces 32 become in a float state during the second interval③, and further, the predetermined voltage of V0 is applied thereto for the fourth period ④. During the first and second periods ① and ②, the voltage of 0V is applied to the second ring-like right-half-electrode pieces 135, and then, the predetermined voltage V0 is applied thereto during the third and fourth periods ③ and ④. As a result, the projecting direction of the toner 21 is deflected as shown by arrows ①, ②, ③ and ④of FIG. 9 during one cycle. In this manner, the image forming apparatus performs the printing operation with the use of the toner thus deflected.

The following is a description on a method of connecting electrode pieces arranged on the same position from each gate 29. For example, in the structure of the image forming apparatus of the first embodiment, power supply wires are arranged in the substrate 26*a* on the counter electrode side. As shown in FIG. 4, a plurality of power supply wires 201 connected individually to the first ring-like right-half-electrode pieces 32 of the gates 29 are connected to each other, and also, a plurality of power supply wires 202 connected individually to the first ring-like left-half-electrode pieces 33 of the gates 29 are connected to each other. By doing so, it is possible to connect electrodes which are situated in a relatively equal position to the hole of each gate 29.

Figure 10A:
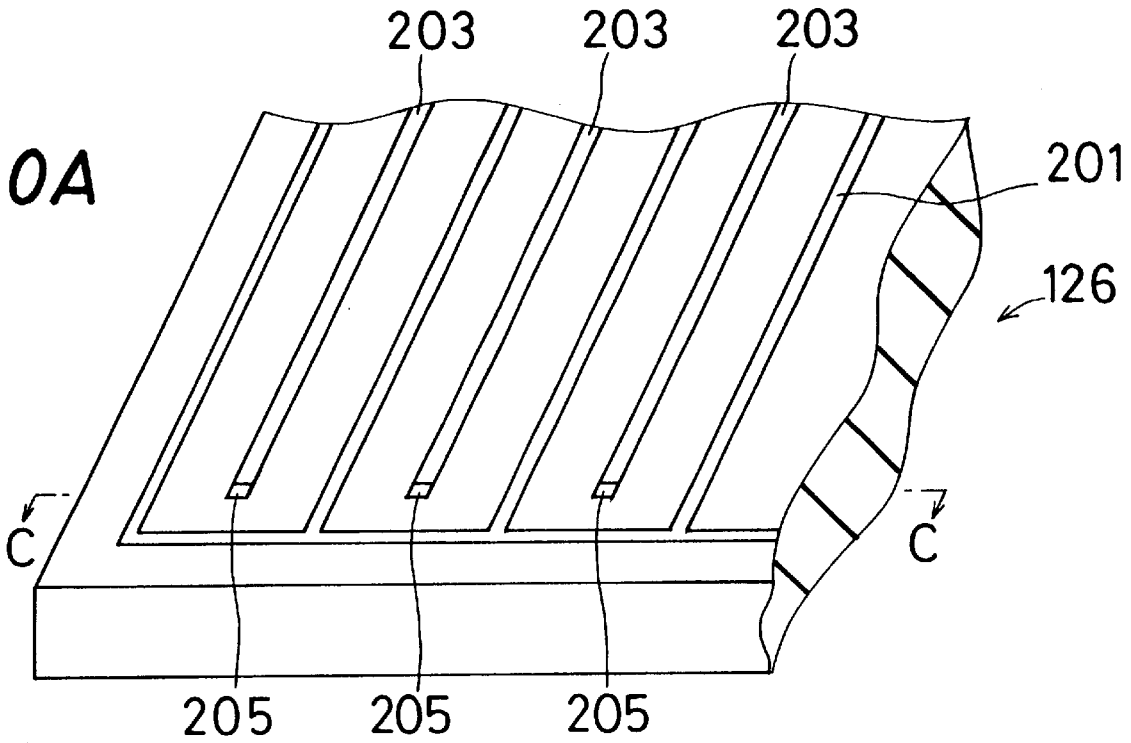
FIG. 10A is a perspective view showing a wire connection state of the control electrode 126 of the image forming apparatus according to the second embodiment.
Figure 10B:
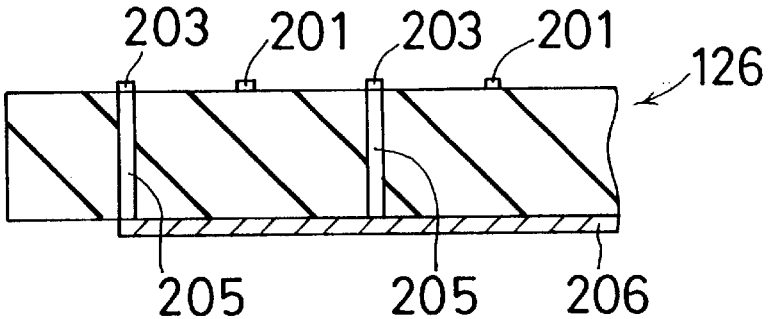
FIG. 10B is a cross-sectional view as cut along a line C—C of FIG. 10, showing a wire connection state of the control electrode 126 of the image forming apparatus according to the second embodiment.

Further, even in the image forming apparatus of the second embodiment like the first embodiment, a plurality of power supply wires 201 and 202 connected individually to the first ring-like right-half- and left-half-electrode pieces 32 and 33 of the gates 29 are respectively connected to each other, and also, a plurality of power supply wires 203 connected individually to the second ring-like right-half-electrode pieces 134 of the gates 29 are connected to each other, and further, a plurality of power supply wires 204 connected individually to the second ring-like left-half-electrode pieces 135 of each gate 29 are mutually connected. These power supply wires 201 and 203 are both arranged on the other side of the substrate 26a; for this reason, it is difficult to respectively connect the power supply wires 201 and 203 on the other side. In order to prevent the power supply wires 201 and 203 from being short-circuited by their contact, as shown in FIG. 10, a plurality of through holes 205 are formed on the substrate 26*a*. The power supply wires 201 are connected on the surface of the substrate 26*a*; on the other hand, the power supply wires 203 are routed to the one side opposite to the above-mentioned other side of the substrate 26*a* wiring power supply wires 203 via the through hole 205, and are connected to each other on the one side via a lead wire 206 for connection. With the construction as described above, in either of the image forming apparatuses of first and second embodiments, it is possible to connect the electrodes to each other which are situated in a relatively equal position to the hole of each gate 29.

As is apparent from the above description, according to the first embodiment, the control electrode 26 of the image forming apparatus comprises a first electrode group composed of a plurality of ring-like electrodes 27, and a second electrode group composed of the first ring-like right-half- and left-half-electrode pieces 32 and 33. Further, according to the second embodiment, the control electrode 126 of the image forming apparatus comprises a first electrode group composed of a plurality of ring-like electrodes 27, and a second electrode group composed of the first ring-like right-half- and lefthalf-electrode pieces 32, 33 and the second ring-like right-half- and left-half-electrode pieces 134, 135. The first ring-like right-half- and left-half-electrode pieces 32 and 33 are individually equivalent to a half-electrode piece obtained by halving each electrode of the electrode group arranged on the counter electrode side of the control electrode in the conventional image forming apparatus.

Figure 11B:
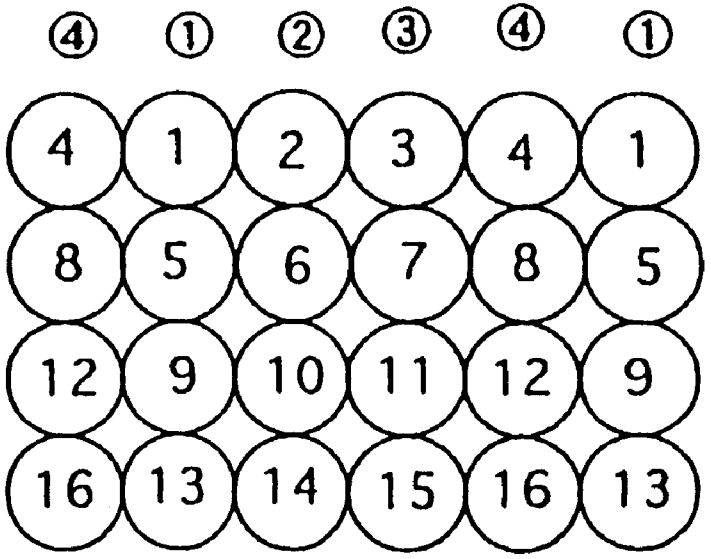
FIG. 11B is a schematic diagram illustrating dot positions in the case of printing the image.
Figure 11A:
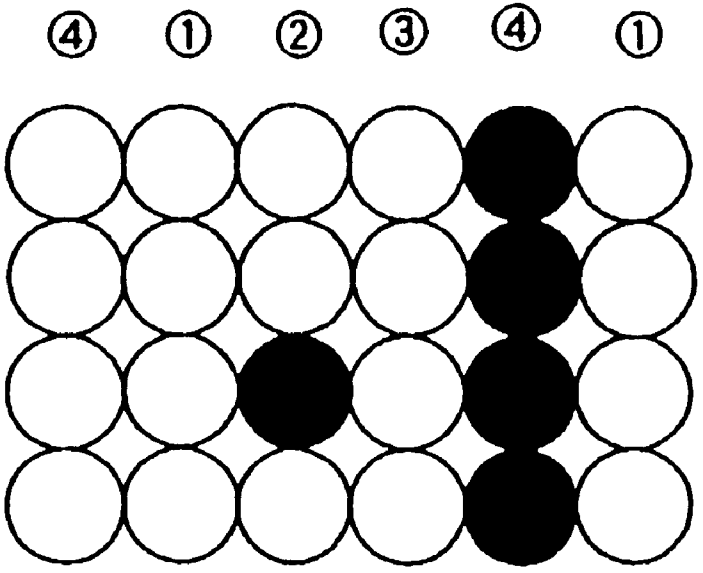
FIG. 11A is a view showing an image printed by the image forming apparatus according to the first and second embodiments.

The following is a description on a method by which at all times a voltage is sequentially applied to the electrode group formed by halving the counter electrode, out of the two electrode groups, and which the electrode group on the toner carrier 22 side, out of the two electrode groups, makes a decision on whether or not to project the toner 21. In this case, in the state as shown in FIG. 6 and FIG. 9B to project the toner, according to the sequence shown in FIG. 12, a voltage is selectively applied to the ring-like electrodes 27 of the gates 29. For example, in the case of printing an image formed from a dot arrangement of 4 lines and 6 columns with the use of the image forming apparatus of the first or second embodiment, a sequence for applying a voltage to the ring-like electrode of each gate 29 is as shown in FIG. 12. A dot to be colored is determined according to the condition of each column of the sequence diagram of FIG. 12. More specifically, as shown in FIG. 11A, the dot to be colored is a dot having the same numeral in the circle in FIG. 11B as the numeral of the column of "printing position" described in FIG. 12 and the number of the toner deflecting direction described in FIG. 12. As a result, in the plurality of electrodes concerning each gate 29, a voltage is applied to the plurality of electrodes arranged on the counter electrode side of the substrate 26*a* in a predetermined pattern during one cycle W to control only the toner projecting direction. Further, the control of passing the toner through each gate 29 depends on whether or not the voltage is applied to the ring-like electrodes 27.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus at least comprising:

supply means having a toner carrier for carrying toner;

a counter electrode arranged to face the toner carrier; and control means including:

a control electrode composed of an insulating substrate disposed between the toner carrier and the counter electrode, a plurality of gates provided in the insulating substrate as toner passages, and two-layer electrode groups composed of a plurality of electrodes individually provided on peripheries of the plurality of gates, and control circuit means capable of applying at least a predetermined potential corresponding to image data to individual electrodes of the control electrode, the image forming apparatus controlling the passage of toner through the plurality of gates by applying the predetermined potential to the electrodes of each electrode group by the control means to form an image on a surface of a recording medium fed between the control electrode and the counter electrode, wherein in order to project the toner at a certain angle from a direction vertical to the toner carrier and the counter electrode, two half-electrode pieces are formed by dividing each electrode of each electrode group on the counter electrode side out of the electrode groups vertically to a paper feed direction, and times for applying a potential to the half-electrode pieces are different.

2. An image forming apparatus at least comprising:

supply means having a toner carrier for carrying toner;

a counter electrode arranged to face the toner carrier; and control means including:

a control electrode composed of an insulating substrate disposed between the toner carrier and the counter electrode, a plurality of gates provided in the insulating substrate as toner passages, and two-layer electrode groups composed of a plurality of electrodes individually provided on peripheries of the plurality of gates, and control circuit means capable of applying at least a predetermined potential corresponding to image data to individual electrodes of the control electrode, the image forming apparatus controlling the passage of toner through the plurality of gates by applying the predetermined potential to the electrodes of each electrode group by the control means to form an image on a surface of a recording medium fed between the control electrode and the counter electrode, wherein in order to project the toner at a certain angle from a direction vertical to the toner carrier and the counter electrode, two half-electrode pieces are formed by dividing each electrode of each electrode group on the counter electrode side out of the electrode groups vertically to a paper feed direction, a plurality of electrode pieces are further provided sequentially in a direction parallel to the paper feed direction with respect to each gate, and a position where a potential is applied is shifted among the two half-electrode pieces and the plurality of electrode pieces.

3. The image forming apparatus of claim 1 or 2, wherein among all of the half-electrode pieces and the electrode pieces, pieces which are situated in corresponding positions to each other in relation to the gates are connected to each other.

4. The image forming apparatus of claim 3, wherein a voltage is always and successively applied to all the electrode pieces, and electrode group on the toner carrier side out of the electrode groups makes a decision either to project the toner or not to do so.

5. The image forming apparatus of claim 2, wherein the control circuit means makes shorter a distance between the pieces, among all of the half-electrode pieces and the electrode pieces, to which the predetermined potential is applied, as the angle formed by the projecting direction of the toner and the direction vertical to the toner carrier and the counter electrode is made wider.

6. The image forming apparatus of claim 1, wherein the control circuit means makes a time of applying the predetermined potential longer as an angle formed by the projecting direction of the toner and the direction vertical to the toner carrier and the counter electrode is made wider.

* * * * *